US005903794A

United States Patent [19]

Sheley et al.

[11] Patent Number: 5,903,794

[45] Date of Patent: May 11, 1999

[54] PROCESSOR AND A DRIVE SYSTEM AND METHOD FOR DRIVING A PHOTOSENSITIVE MATERIAL THROUGH THE PROCESSOR

[75] Inventors: Raymond F. Sheley, Spencerport; Richard M. Pochatko, Rochester, both of N.Y.

[73] Assignee: Eastman Kodak Company, Rochester, N.Y.

[21] Appl. No.: 09/014,228

[22] Filed: Jan. 27, 1998

[51] Int. Cl.[6] ..... G03D 3/08

[52] U.S. Cl. ..... 396/612; 226/24

[58] Field of Search ..... 396/570, 578, 396/612, 615, 616, 619; 226/16, 24, 104, 29; 242/334.6, 356.3, 352, 412.2; 352/124, 168

[56] References Cited

U.S. PATENT DOCUMENTS

| | | | |
|---|---|---|---|
| 1,653,451 | 12/1927 | De Ybarrondo | 226/42 |
| 2,048,182 | 7/1936 | De Ybarrondo | 226/11 |
| 4,099,193 | 7/1978 | Leuchter et al. | 396/616 |
| 4,350,275 | 9/1982 | Kuhn | 242/24 |
| 4,385,821 | 5/1983 | Kachelries | 396/616 |
| 4,729,520 | 3/1988 | Kataoka | 242/412.2 |
| 4,967,222 | 10/1990 | Nitsch | 396/616 |
| 5,223,882 | 6/1993 | Beckmann | 396/616 |
| 5,318,796 | 6/1994 | Torpey et al. | 118/33 |
| 5,463,440 | 10/1995 | Panontin et al. | 396/568 |

*Primary Examiner*—D. Rutledge
*Attorney, Agent, or Firm*—David A. Novais

[57] ABSTRACT

A primary drive assembly which drives photosensitive material through a photographic processor is provided at a point of a photoprocessing path of the processor at which a precise speed control is desired. A secondary drive assembly is provided downstream of the primary drive assembly at the end of the processor to pull the photosensitive material through the end of the processor. The primary drive assembly includes a control member which controls the speed of the secondary drive assembly based on the tension of the photosensitive material in the vicinity of the primary drive assembly. If the tension is below a predetermined point, the speed of the secondary drive assembly is increased, and if the tension is too high, the speed of the secondary drive assembly is decreased. The primary drive assembly uses a pivotable roller arrangement in combination with a switch to monitor tension and supply a signal to the secondary drive assembly.

16 Claims, 4 Drawing Sheets

PROCESSOR AND A DRIVE SYSTEM AND METHOD FOR DRIVING A PHOTOSENSITIVE MATERIAL THROUGH THE PROCESSOR

FIELD OF THE INVENTION

The present invention relates to the field of photoprocessing. More particularly, the present invention relates to a processor as well as a drive system and method for driving a photosensitive material through the processor.

BACKGROUND OF THE INVENTION

The processing of photographic film in a processor or processing assembly involves a series of steps such as developing, bleaching, fixing, washing and drying. These steps lend themselves to mechanization by conveying a continuous web of film or cut sheets of film or photographic paper sequentially through a series of processing stations or processor tanks which make up the processor, each one containing a different processing solution appropriate to the process step at that station. Typical drive systems for processors are designed to provide on-demand power to each or any of roller systems which are located in each of the processor tanks for conveying photosensitive material. For some processors, the film path through which the film travels can be described as a spiral path through the various tanks with the number of turns through each of the tanks being determined by the particular process in the tank. Due to this variation, as well as a difference in wet film stretch, the action of flex hubs, mechanical binding, rubbing, etc., each tank of a processor typically places different tension load demands onto that portion of the processor. The various tension loads coupled with low operating tension allowances desired by current processors indicates the need for an on-demand drive system between each of the processing tanks.

On-demand drive systems are typically defined as any system that has a pacer roller located at the take-up end of the processor. This pacer roller is the only film roller that is constantly positively driven. The other rollers can be idler-style rollers that provide positive drive only when that portion of the film web exceeds the design film tension.

A film transport rack system for each processor tank of a typical processing system will have a constant turning drive roll, which is regulated to a speed that is generally about 5% to 15%, typically 5% to 8%, faster than the speed provided by the pacer roller. In this system, the pacer roller determines the rate of speed that the film should travel through the tank, dryer and take-up system. In theory, the film could be pulled through the various tank/rack systems, then be fed through an exit elevator, then onto a take-up reel. Unfortunately, the web tension of the film would most likely be too great at different points along the film path and additional driving is needed at various (and changing) positions, at intermittent time periods.

One proposed solution is to use a spring mounted roller hub (flex hub drive) within the tank that allows the roller hub to be pulled down to engage a constant speed drive roller assembly when that particular section of the film web is undergoing high tension. The amount of allowable tension can be varied in gross amounts by using different tension spring hubs and tuning can be accomplished by the use of adjusting rods on the film hub axis. Adjusting the spacing or gap of the roller hub further away from the drive roller increases the required tension level to engage the drive while narrowing the spacing or gap decreases it. However, this approach has a drawback in that as you proceed further upstream from the pacer roller located at the end of the take-up end of the processor, there is a greater intermittent film motion mainly caused by the cumulative effect of changing center lines caused by the action of flex hubs, which contributes to increase the tension loads.

Recent designs require that photoprocessing film be subject to relatively light film tensions, and that a fine control of film motion be achieved at a certain point of the processing path, such as at a blue exposure lamp housing of a KODACHROME film processing lab, an ink jet machine, an air flow coating mechanism, etc. The speed of the film at the blue exposure lamp housing or any of the elements noted above needs to be finely controlled since an increase in residence time of the film in a vicinity of the blue exposure lamp housing or any of the elements noted above will adversely affect film development. Conventional assemblies do not provide for a fine control of film motion at a specific point, such as, a blue exposure lamp housing of a processor which is typically at an intermediate location of the processing path of the processor.

Typically, as explained above, to regulate proper low film tension, a flex hub drive is used which allows the film to travel over a series of roller assemblies in an idler roller mode when the film is under low tension. Under higher tension conditions the flex hubs deflect the roller assembly until the roller contacts a constantly turning overdrive roller which provides additional assist to the drive system. When the high tension condition is relieved, the flex hubs return the roller assembly to its idler roller position. However, as noted above, this kind of system does not provide for a fine control of the motion of the film at an intermediate portion of the processing assembly. This is detrimental in, for example, KODACHROME processing in which low tension is desired because the processing involves stapling or splicing multiple films together, and in which a blue exposure lamp housing is typically provided in an intermediate location of the photoprocessing system where a precise film speed control and motion is desired to prevent overexposure.

An arrangement such as shown in U.S. Pat. No. 4,967,222 uses two motors to regulate the film speed through a large processing tank in which the film path length is variable. This arrangement monitors the speed of a web at the inlet of the tank, and uses this monitored speed to regulate the speed of advancing rolls at the outlet of the developing tank in such a way that the speeds match. However, this system is not concerned with a monitoring of film tension and a control of a secondary drive provided downstream of a primary drive based on the monitored tension in a vicinity of the primary drive.

SUMMARY OF THE INVENTION

The present invention provides for a drive system for driving a photosensitive material through a processor which includes a primary or center drive assembly that is provided in between processing tanks of the processor and is preferably provided next to a point of the processor where the photosensitive material requires precise speed control. For example, in a KODACHROME processor, this point is next to a blue exposure lamp housing where the photosensitive material needs to be maintained at a substantially constant speed. The drive system of the present invention further includes a secondary or take-up drive assembly which is provided downstream of the primary drive assembly and at the end of the processor to pull the photosensitive material through the end of the processor. The secondary drive assembly is controlled and driven in response to a tension of the photosensitive material at a specific location after or in the vicinity of the primary drive assembly. If the tension at this specific location is below a predetermined point, the take-up speed of the secondary drive assembly is increased. If the tension at this location is too high, then the take-up speed of the secondary drive is decreased. The primary drive system of the present invention includes a pivotable roller and switch assembly which is utilized to monitor tension and control the take-up speed of the secondary drive assembly based on the monitored tension.

The present invention provides for a drive system for driving a photosensitive material through a processing assembly. The drive system comprises a first drive assembly which transports photosensitive material along a processing path of the processing assembly, with the first drive assembly being provided at a first location along the processing path; and a second drive assembly which further transports the photosensitive material. The second drive assembly being provided at a second location of the processing path downstream of the first drive assembly. The first drive assembly comprises a control member which controls a take-up speed of the second drive assembly based on a tension in a vicinity of the first drive assembly of the photosensitive material being transported along the processing path.

The present invention also provides for a photoprocessing assembly for processing a photosensitive material. The photoprocessing assembly comprises a processing path for the photosensitive material, with the processing path extending through the photoprocessing assembly; a primary drive assembly which transports the photosensitive material through the processing path, with the primary drive assembly being mounted at a first location along the processing path; and a secondary drive assembly provided at a second location of the processing path which is downstream of the primary drive assembly which pulls the photosensitive material through the processing path. The primary drive assembly comprises a control member which controls the speed of the secondary drive assembly in response to a tension of the photosensitive material in the processing path in a vicinity of the primary drive assembly.

The present invention also provides for a method of driving a photosensitive material through a processing path of a processing assembly. The method comprises the step of providing a primary drive assembly at a first location along the processing path. The primary drive assembly transports the photosensitive material through the processing path. The method also comprises the steps of providing a secondary drive assembly at a second location of the processing path downstream of the primary drive assembly, with respect to the transporting direction of the photosensitive material, to further transport the photosensitive material through the processing path; and controlling the speed of the secondary drive assembly based on a tension of the photosensitive material in a vicinity of the primary drive assembly.

DETAILED DESCRIPTION OF THE INVENTION

Figure 1:
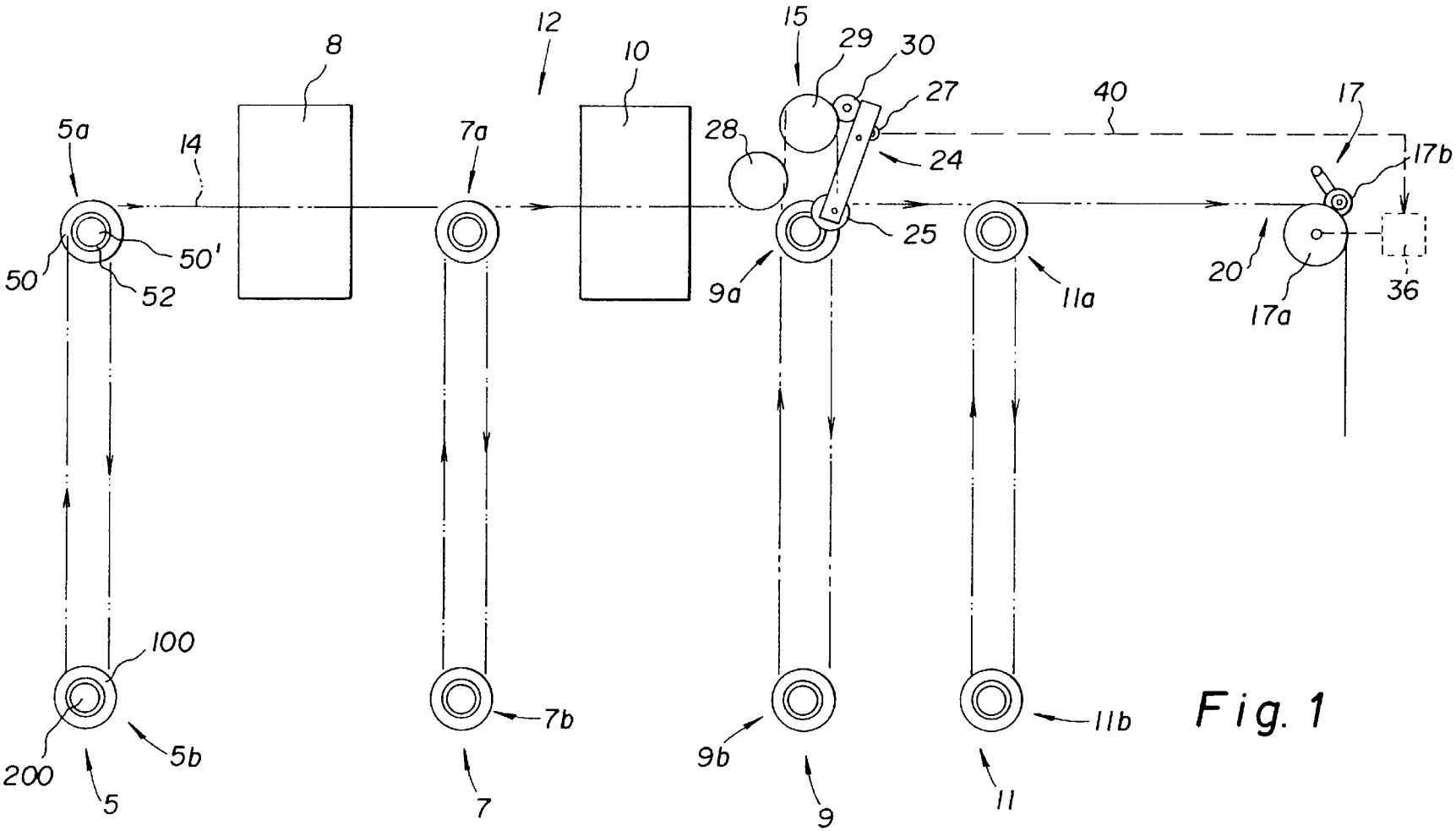
FIG. 1 schematically illustrates a photoprocessing path of a processing assembly and the positioning of a primary drive assembly and a secondary drive assembly along the photoprocessing path.

Referring now to the drawings, wherein like reference numerals designate identical or corresponding parts throughout the several views, FIG. 1 is a schematic view of a processing path 14 of photosensitive material through a processing assembly generally represented by reference numeral 12. The path of the photosensitive material through processing path 14 is represented by the arrows in FIG. 1. Reference numerals 5, 7, 9 and 11 schematically represent different processing stations or processing tanks of processing assembly 12. In each processing station 5, 7, 9, 11, a different processing step is performed. For descriptive purposes, in the example of FIG. 1, a KODACHROME processing is shown. However, it is recognized that the arrangement of the present invention is not limited to KODACHROME processing and can be applied to any processing system where a control of film motion at a certain point, such as at an ink jet machine, an air flow coating mechanism, etc., is desired.

Figure 2:
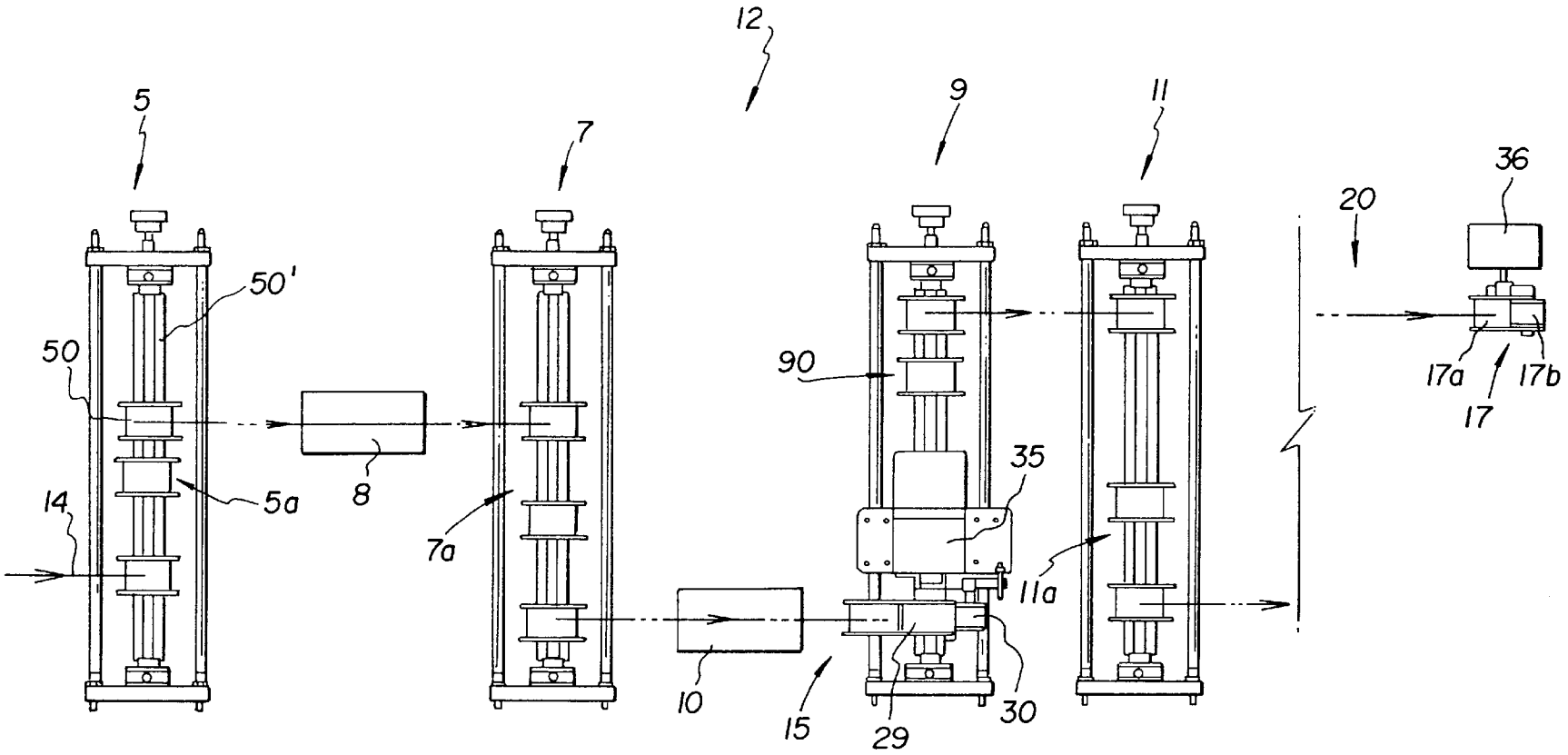
FIG. 2 is a top view of the photoprocessing path of the processing assembly of FIG. 1.

As illustrated in FIG. 1, photosensitive material is first guided around upper and lower roller assemblies 5*a*, 5*b* of processing station 5 and is then conveyed to second processing station 7 where the photosensitive material is guided by upper and lower roller assemblies 7*a* and 7*b*. In KODACHROME processing, a red exposure lamp housing 8 is located along processing path 14 between processing stations 5 and 7. After exiting processing station 7, the photosensitive material passes by a blue lamp exposure housing 10 located along processing path 14 and enters processing station 9. As illustrated in FIG. 1, a primary or center drive assembly 15 is located along processing path 14 above processing station 9 which conveys the photosensitive material along and through processing assembly 12, and leads the photosensitive material into processing station 9 where it is guided by upper and lower roller assemblies 9*a* and 9*b*. After the photosensitive material exits processing station 9, it is transported to processing station 11 where it is guided by upper and lower roller assemblies 11*a*, 11*b* and thereafter lead to a secondary drive assembly 17 which pulls the photosensitive material through processing assembly 12 and leads the same through an exit 20 of processing assembly 12. As shown in FIG. 2, primary drive assembly 15 can be driven by a motor 35, while secondary drive assembly 17 can be driven by a motor 36.

FIG. 1 shows one example of a processing assembly used for KODACHROME processing. It is recognized that the type of processing assembly utilized when the context of the present invention is based on design considerations and the type of photoprocessing desired. Also, although only upper and lower roller assemblies are described and shown for each station 5, 7, 9 and 11, it is recognized that each station can include further roller assemblies depending on design considerations.

As illustrated in FIG. 2, in processing systems such as KODACHROME processing in which a low tension is desired, processing path 14 can be a spiral path. Also, to help prevent photosensitive material breakage, a flexible hub drive can be utilized. As shown in FIG. 2, the spiral path goes through each of processing stations 5, 7, 9, 11 and the roller assemblies in which FIG. 2 shows the upper roller assemblies 5*a*, 7*a*, 9*a*, and 11*a* for each of processing stations 5, 7, 9, and 11. As already described, each processing station 5, 7, 9, 11 can respectively include upper and lower roller assemblies 5*a*, 5*b*; 7*a*, 7*b*; 9*a*, 9*b*; 11*a*, 11*b* and further roller assemblies depending on design considerations. For each processing station 5, 7, 9, 11, the lower roller assembly 5*b*, 7*b*, 9*b*, 11*b* is not a flex hub drive and generally comprises a hub 100 fixed on a shaft 200; while at least one of the remaining roller assemblies can be a known flex hub drive arrangement. Looking at processing station 5 as an example, the upper roller assembly 5*a* can be a flex hub drive arrangement which comprises a hub 50 rotatably and flexibly mounted on a shaft 50' by way of respective flexible members 52 as illustrated in FIGS. 1 and 2. As shown in FIG. 1, and using processing station 5 as an example, when the photosensitive material is under low tension, hub 50 is an idler roller which rotates as the photosensitive material passes around hub 50 which is flexibly and rotatably mounted to shaft 50' by way of flexible members 52. Under higher tension conditions hub 50 will deflect until it contacts shaft 50' which is a constantly driven overdrive shaft that provides an additional drive assistance to the photosensitive material. When the high tension condition is relieved, hub 50 returns to its idler roller mode. As noted above, the flex hub drive has been described with reference to roller assembly 5*a* of processing station 5. It is recognized that each processing station 7, 9, 11 can include at least one flex hub drive which is similar in structure and operation to flex hub drive 5*a*. Therefore, under higher tension conditions the hubs deflect until they contact a constantly turning overdrive shaft or roller which provides additional assist to the drive system. When the high-tension condition is relieved, the hub returns to its idler roller position.

In some processing arrangements, it is desired that the speed of the photosensitive material at a specific point of the processor be finely controlled or maintained constant. In KODACHROME processing as an example, the specific point is the area of blue exposure lamp housing 10. If the residence time of the photosensitive material at the area of blue exposure lamp housing 10 is too long, the photosensitive material could be over-exposed or damaged. In order to properly control the speed of the photosensitive material in the vicinity of, for example, blue lamp exposure housing 10, the present invention provides for the positioning of primary drive assembly 15 and secondary drive assembly 17 as shown in FIGS. 1 and 2. That is, primary drive assembly 15 is mounted in the vicinity of blue exposure lamp housing 10 and above one of the intermediate processing stations 9 to drive the photosensitive material along and through processing assembly 12; while secondary drive assembly 17 is mounted at exit 20 of processing assembly 12 and is a take-up drive system which pulls the photosensitive material from processing assembly 12. Primary drive assembly 15 further includes a control member 24 which controls a speed of secondary drive assembly 17 through a signal 40 based on a monitored tension of the photosensitive material in the vicinity of primary drive assembly 15. As shown in FIG. 1, signal 40 is applied to motor 36 in order to control the speed of secondary drive assembly 17.

As previously described, in processing systems which utilize only a take-up speed drive at the end of the processing assembly, it is difficult to control the speed of the photosensitive film at intermediate positions along the processing path; in addition, the use of only a take-up drive at the end of the processing assembly may create too great a tension on the photosensitive material and is also a contributor to the increasing occurrences of intermittent motion noted the further away you travel from the take-up drive. The use of a flex hub drive arrangement in combination with a take-up drive at the end of the processing assembly creates an increasingly greater intermittent film motion as you proceed further upstream from the take-up drive. This again makes it difficult to control the speed of the photosensitive material at an intermediate portion of the processing path such as at the blue exposure lamp assembly.

Figure 3:
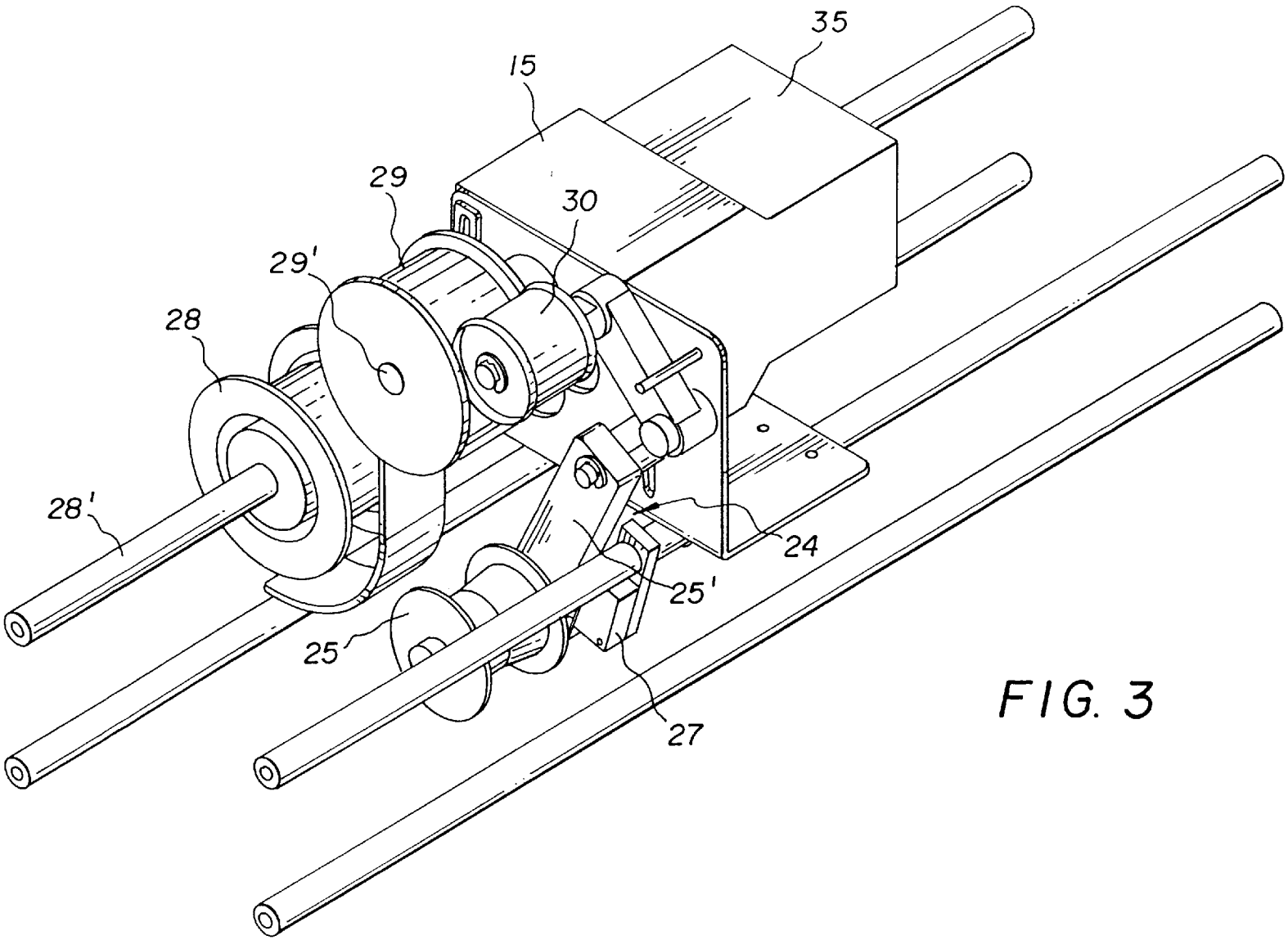
FIG. 3 is a perspective view of the primary drive assembly of FIG. 1.
Figure 4:
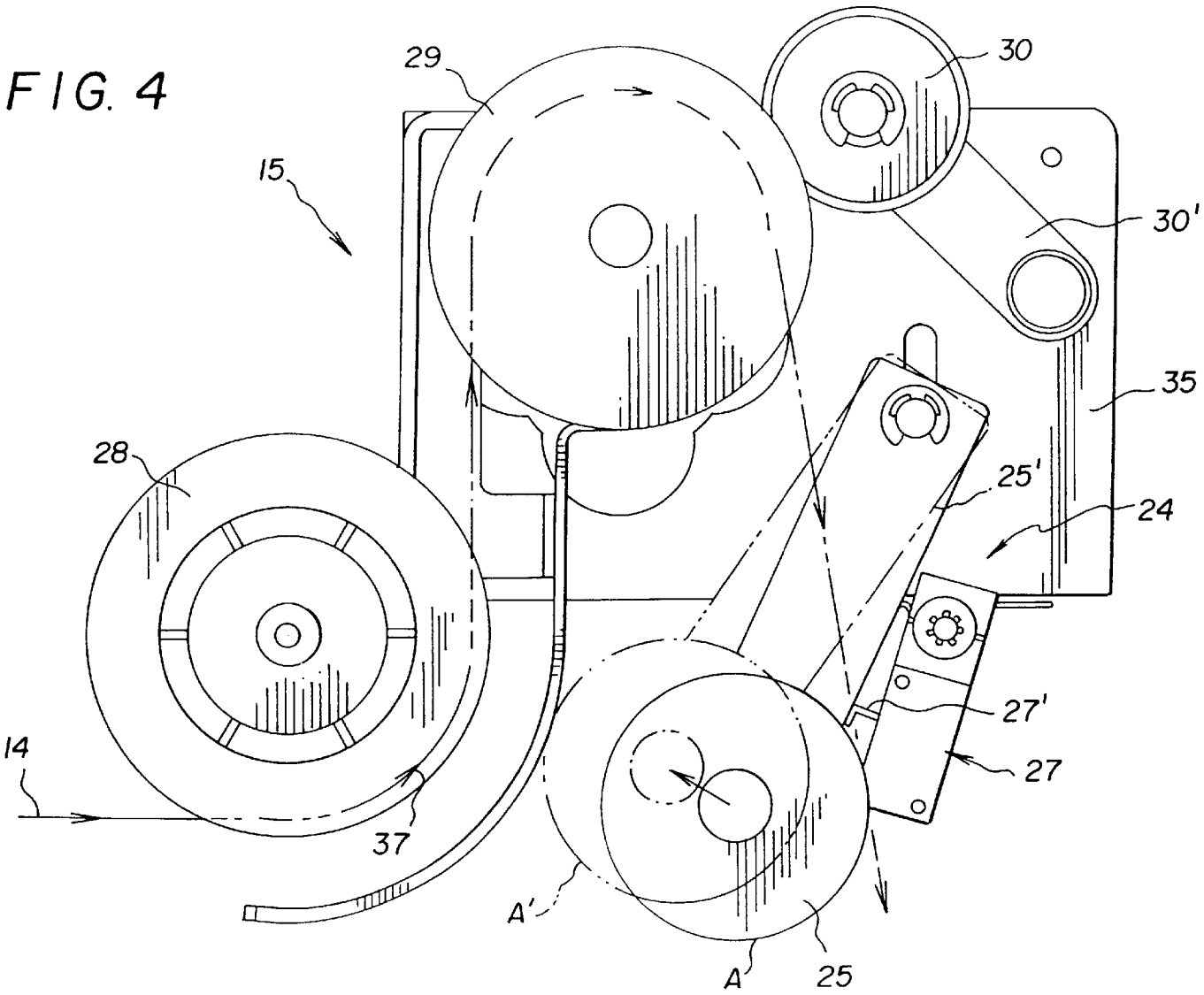
FIG. 4 is a detailed side view of the primary drive assembly.

In order to accurately control the speed of the photosensitive material through blue exposure lamp housing 10 and at the same time control the amount of tension applied to the photosensitive material, control member 24 of primary drive assembly 15 comprises a pivotable roller 25 and a switch assembly 27 as illustrated in FIGS. 3 and 4. Pivotal roller 25 is mounted on a lever 25' to form a pivotal roller arrangement.

Looking at FIGS. 3 and 4 which are detailed views of primary drive assembly 15, in addition to control member 24, primary drive assembly 15 includes a first roller 28 rotatably mounted on shaft 28' which can be a flex hub type roller similar to the flex hub described with reference to guide roller assembly 5*a*, a second roller 29, and a third roller 30 which is in contact with second roller 24. Primary drive assembly 15 further includes motor 35 which is drivingly connected to roller 29 via shaft 29'. As shown in FIG. 4, the photosensitive material is guided by first roller 28 and then passes between second and third rollers 29 and 30 toward pivotal roller 25 and into processing station 9 as indicated by dashed line and arrows 37 which makes up part of processing path 14. Third roller 30 is pivotally mounted to a housing or bracket for motor 35 by way of a lever 30' so as to be urged into contact with second roller 29 and to accommodate for different photosensitive materials. Pivotal roller 25 is pivotally mounted to the bracket or housing for motor 35 via lever 25' so as to be urged against a contact switch 27' provided on switch assembly 27 which is also mounted to the bracket or housing for motor 35. Primary drive assembly 15 can be mounted to processing assembly 12 by any known manner through for example, shafts or mounts.

As illustrated in FIGS. 1 and 2, secondary drive assembly 17 includes rollers 17*a*, 17*b* between which the photosensitive material passes, as well as motor 36 which can be drivingly connected to roller 17*a* so as to pull the photosensitive material from processing assembly 12.

The speed of secondary drive assembly 17 is controlled in response to a monitored tension of the photosensitive material at a specific point after or in a vicinity of primary drive assembly 15 as follows. If the tension of the photosensitive material at the specific point is above a predetermined tension, that is, a tension that can cause a breakage of the photosensitive material, the photosensitive material which is tensioned will abut against pivotal roller 25 and impart a pivotal motion to pivotable roller 25 and lever 25' in the direction of arrow B, from a position A shown in solid line in FIG. 4, to a position A' shown by double-dashed lines in FIG. 4. This movement spaces pivotal roller 25 and lever 25' away from switch 27' to a non-contact position, and provides a signal via line 40 (FIG. 1) to motor 36 of secondary drive assembly 17 to decrease the speed of secondary drive assembly 17 to a film transport speed which is below that of a calibrated machine developing film speed. On the other hand, when the tension of the photosensitive material decreases, the photosensitive material will slacken and permit pivotable roller 25 and lever 25' to move back to position A and into contact with switch 27', so as to provide a signal via line 40 to motor 36 of secondary drive assembly 17 to increase the speed of secondary drive assembly 17.

Accordingly, pivotable roller 25 and lever 25', in combination with switch 27' of switch assembly 27 can use the motion imparted on slack or high tension photosensitive film or material to increase or decrease the speed of secondary drive assembly 17 while the speed of primary drive assembly 15 stays constant. This function is continuously monitored as the photosensitive material passes through primary drive assembly 15 to provide for a close calibration of speed changes and prevent high tension film breaks or over-slacking of the photosensitive material or film.

Therefore, with the combination of pivotable roller 25, lever 25' and switch assembly 27 of the present invention, high film tension will result in a secondary drive or take-up speed of secondary drive assembly 17 that decreases the film transport speed to a level just below that of the calibrated machine development film speed, while low film tension will result in a take-up speed of secondary drive assembly 17 that will eliminate slack film in an area downstream of primary drive assembly 15. The switching of the take-up speeds of secondary drive assembly 17 will balance out the higher and lower tensions caused by the action of primary drive assembly 15. As a result, the speed of photosensitive film as it passes through a specific design point of a processor, such as a blue exposure lamp housing as illustrated in FIG. 1, an ink jet machine, an air flow coating mechanism, etc., where it is desired to reduce, minimize or make constant the residence time of the film at that point, can be precisely controlled.

The invention has been described in detail with particular reference to certain preferred embodiments thereof, but it will be understood that variations and modifications can be effected within the spirit and scope of the invention.

What is claimed is:

1. A drive system for driving a photosensitive material through a processing assembly, the drive system comprising:

a first drive assembly which transports photosensitive material along a processing path of the processing assembly, said first drive assembly being provided at a first location along the processing path; and a second drive assembly which further transports the photosensitive material along the processing path, said second drive assembly being provided at a second location of said processing path downstream of the first drive assembly;

wherein the first drive assembly comprises a control member which controls a take-up speed of said second drive assembly based on a tension in a vicinity of the first drive assembly of the photosensitive material being transported along the processing path.

2. A drive system according to claim 1, wherein said control member comprises a pivotal roller arrangement operationally associated with a switch, such that when the tension of the photosensitive material is below a predetermined tension the pivotal roller arrangement is in a first operating position and the switch provides a signal to said second drive assembly to increase the take-up speed of said second drive assembly, and when the tension of the photosensitive material is above said predetermined tension, said pivotal roller arrangement is pivoted by the photosensitive material to a second operating position and said switch provides a signal to said second drive assembly to decrease the take-up speed of the second drive assembly.

3. A drive system according to claim 1, wherein said first drive assembly comprises at least one roller which is driven by a motor.

4. A drive system according to claim 1, wherein said first location of said first drive assembly is above an intermediate processing tank of said processing assembly.

5. A drive system according to claim 1, wherein said first drive assembly is provided at an approximately intermediate position of the processing path and said second drive assembly is mounted at an end of the processing assembly so as to pull the photosensitive material through said processing assembly.

6. A drive system according to claim 1, wherein said processing assembly comprises a plurality of processing tanks, and said processing path is a spiral path through said processing path.

7. A photoprocessing assembly for processing a photosensitive material, said photoprocessing assembly comprising:

a processing path for the photosensitive material, said processing path extending through said photoprocessing assembly;

a primary drive assembly which transports the photosensitive material through the processing path, said primary drive assembly being positioned at a first location along said processing path; and a secondary drive assembly provided at a second location of said processing path downstream of the primary drive assembly, said secondary drive assembly pulling the photosensitive material through said processing path;

wherein said primary drive assembly comprises a control member which controls a speed of said secondary drive assembly in response to a tension of the photosensitive material in the processing path in a vicinity of the primary drive assembly.

8. A photoprocessing assembly according to claim 7, wherein said control member comprises a pivotal roller arrangement operationally associated with a switch assembly, such that when the tension of the photosensitive material is below a predetermined tension the pivotal roller arrangement is in a first position and the switch assembly provides a signal to said secondary drive assembly to increase the speed of the secondary drive assembly, and when the tension of the photosensitive material is above said predetermined tension said pivotal roller arrangement is pivoted to a second position and said switch assembly provides a signal to said secondary drive assembly to decrease the speed of the secondary drive assembly.

9. A photoprocessing assembly according to claim 7, wherein said primary drive assembly comprises at least one roller which is driven by a motor.

10. A photoprocessing assembly according to claim 7, wherein said photoprocessing assembly comprises a plurality of processing tanks and said primary drive assembly is mounted above an intermediate processing tank of said plurality of processing tanks.

11. A photoprocessing assembly according to claim 10, wherein said primary drive assembly is mounted in a vicinity of a lamp housing in said photoprocessing assembly.

12. A method of driving a photosensitive material through a processing path of a processing assembly, the method comprising the steps of:

providing a primary drive assembly at a first location along the processing path, said primary drive assembly transporting the photosensitive material through the processing path;

providing a secondary drive assembly at a second location downstream of the primary drive assembly, with respect to a transporting direction of said photosensitive material, to further transport the photosensitive material through the processing path; and controlling a speed of the secondary drive assembly based on a tension of the photosensitive material in a vicinity of the primary drive assembly.

13. A method according to claim 12, wherein said controlling step comprises the steps of:

increasing the speed of the secondary drive assembly when the tension of the photosensitive material is below a predetermined tension; and decreasing the speed of the secondary drive assembly when the tension of the photosensitive material is above the predetermined tension.

14. A method according to claim 12, wherein said primary drive assembly is located above an intermediate tank of said processing assembly and in a vicinity of a lamp housing in the processing assembly.

15. A method according to claim 12, wherein said secondary drive assembly is located at an end of the processing assembly so as to pull the photosensitive material through the processing path.

16. A method according to claim 12, wherein said primary drive assembly is located in a vicinity of a lamp housing in the processing assembly.

* * * * *